United States Patent [19]

Tamura

[11] 4,377,332

[45] Mar. 22, 1983

[54] DEVELOPING DEVICE

[75] Inventor: Yasuyuki Tamura, Kawasaki, Japan

[73] Assignee: Canon Kabushiki Kaisha, Tokyo, Japan

[21] Appl. No.: 138,909

[22] Filed: Apr. 10, 1980

[30] Foreign Application Priority Data

Apr. 20, 1979 [JP] Japan ..... 54/48718
Feb. 12, 1980 [JP] Japan ..... 55/16453

[51] Int. Cl.[3] ..... G03G 15/09

[52] U.S. Cl. ..... 355/3 DD; 355/14 D; 118/658; 427/14.1; 430/122

[58] Field of Search ..... 118/657, 658, 623, 620–621, 118/624, 653–656, 640; 355/3 DD, 14 D, 10, 77; 430/120, 122, 45, 111, 121, 123, 128, 129; 427/13, 14.1, 25, 27

[56] References Cited

U.S. PATENT DOCUMENTS

| | | | |
|---|---|---|---|
| 2,910,963 | 11/1959 | Herman | 118/657 X |
| 3,863,603 | 2/1975 | Buckley et al. | 118/658 |
| 3,909,258 | 9/1975 | Kotz | 430/122 |
| 4,018,187 | 4/1977 | Abbott et al. | 118/658 |
| 4,200,665 | 4/1980 | Suzuki et al. | 118/658 X |
| 4,218,691 | 8/1980 | Fujii | 118/657 X |
| 4,240,740 | 12/1980 | Young | 118/657 X |

FOREIGN PATENT DOCUMENTS

| | | | |
|---|---|---|---|
| 2752561 | 6/1978 | Fed. Rep. of Germany | 118/657 |
| 5086368 | 1/1977 | Japan | 118/657 |
| 54-104351 | 8/1979 | Japan | 118/657 |
| 2029279 | 3/1980 | United Kingdom | 118/657 |

*Primary Examiner*—S. J. Witkowski
*Assistant Examiner*—Richard M. Moose
*Attorney, Agent, or Firm*—Fitzpatrick, Cella, Harper & Scinto

[57] ABSTRACT

To form an irregularity-free thin layer of developer on a developer supporting member, the surface of the developer supporting member is formed with concavo-convexities along the conveyance direction thereof. To eliminate any irregularity of the developer layer on the developer supporting member and to sufficiently impart charge to the developer by the friction between the developer and the supporting member, the concavo-convexities should preferably have a pitch of 5–100μ, a concavity depth d of 0.2–10μ and a concavity width W of 2d–3d. The concavo-convexities should desirably be rounded rather than sharp.

23 Claims, 14 Drawing Figures

DEVELOPING DEVICE

BACKGROUND OF THE INVENTION

1. Field of the Invention

This invention relates to a developing device using one-component magnetic toner as developer.

2. Description of the Prior Art

As a developing method using one-component magnetic toner, the developing method using electrically conductive magnetic toner disclosed in U.S. Pat. No. 3,909,258 is known and has been widely used. However, in such developing method, the toner must essentially be electrically conductive and with the electrically conductive toner, it has been difficult to have a toner image on a latent image bearing member transferred to a final image supporting member (for example, plain paper or the like) by the utilization of an electric field (although the reason therefor has not yet been clarified sufficiently).

The assignee of the present invention has previously proposed novel developing methods which eliminate such disadvantage peculiar to the conventional developing method using one-component magnetic toner. They are disclosed, for example, in U.S. application Ser. Nos. 58,434 abandoned in favor of Continuation U.S. application Ser. No. 264,516 filed May 18, 1982 and U.S. Pat. No. 4,292,387. These methods comprise uniformly applying insulative magnetic toner onto a cylindrical developer supporting member having a magnet therewithin, causing the same to be opposed to a latent image bearing member without bringing it into contact with the latter, thereby effecting development. At this time, a low-frequency alternating voltage is applied between the developer supporting member and the substrate conductor of the latent image bearing member to cause reciprocal movement of the toner between the developer supporting member and the latent image bearing member, whereby it is possible to accomplish good development which is fogless and excellent in reproduction of tone gradation and free of thinning at the ends of the image. In these developing methods, the toner is an insulator and this facilitates the image transfer.

In such developing methods, it is very important to uniformly apply the toner onto the developer supporting member. That is, if the toner layer on the developer supporting member becomes excessively thick, not only the toner is rubbed against the latent image bearing member but also the frictional charging of the toner due to the friction between the toner and the developer supporting member tends to become insufficient. On the other hand, if the toner layer becomes thin, the amount of toner used for the development becomes deficient and thus, the density of the developed image becomes unsatisfactory.

SUMMARY OF THE INVENTION

It is an object of the present invention to eliminate the above-noted disadvantages peculiar to the prior art and to provide a developing device for effecting development with a uniform, irregularity-free, thin layer of developer being formed on the developer supporting member.

It is another object of the present invention to provide a device for effecting development with sufficient frictional charge being imparted to one-component developer.

It is still another object of the present invention to provide a developing device which has an improved developer conveying performance.

It is yet still another object of the present invention to provide a developing device in which fusion of the developer to the developer supporting member is prevented.

It is another object of the present invention to provide a method whereby concavo-convexities are successively formed on the surface of the developer supporting member along the developer conveyance direction thereof.

The invention which achieves these objects consists in a developing device which has a developer comprising one-component magnetic toner, a container for containing said developer therein, a developer supporting member supported by said container, magnetic field generating means disposed within said developer supporting member, and a thickness controlling member disposed in proximity to the developer supporting member for controlling the thickness of the developer layer on the surface of said supporting member, the surface of said developer supporting member being formed with concavo-convexities. If the concavo-convexities are formed on the surface of the developer supporting member along the conveyance direction thereof, vibrations may be imparted to the developer to thereby prevent irregularity of the thickness of the developer layer. To have sufficient charge imparted to the developer by the friction between the developer layer on the developer supporting member and the supporting member and to prevent the fusion of the developer to the supporting member, the concavo-convexities may preferably have a pitch P of 5–100$\mu$, a concavity depth d of 0.2–10$\mu$ and a concavity width W of 2d–3d. Further, in a developing method wherein a low-frequency alternating voltage is applied between the developer supporting member and the latent image bearing member to cause the developer to fly from the supporting member to the latent image surface to thereby effect development, the concavity depth d should preferably be 0.2–5$\mu$ in order to prevent the electric field from concentrating in the concavo-convexities due to the alternating voltage to disturb the image.

The above and other objects and features of the present invention will become more fully apparent from the following detailed description taken in conjunction with the accompanying drawings.

DESCRIPTION OF THE PREFERRED EMBODIMENTS

Embodiments of the developing device according to the present invention will hereinafter be described in detail while being compared with the prior art examples.

Figure 1:
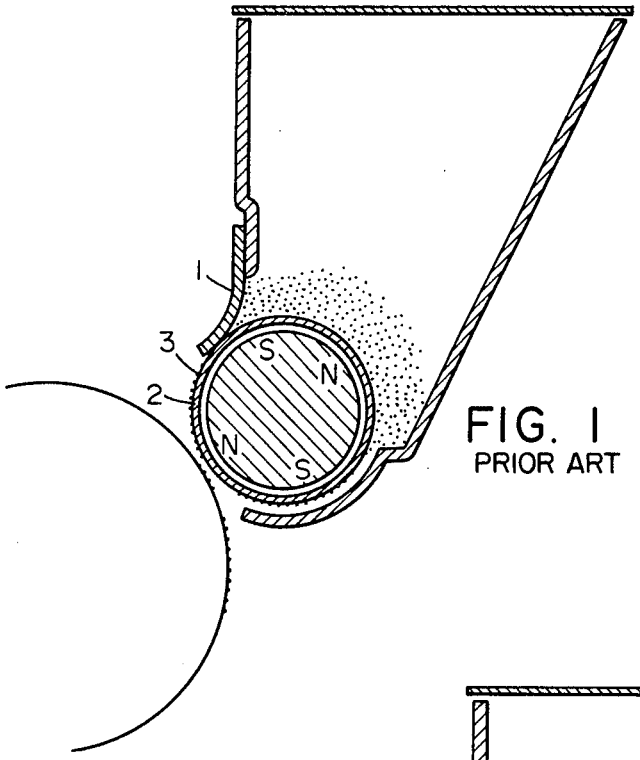
FIG. 1 PRIOR ART
FIG. 1 is a cross-sectional view of a developing device using an elastic blade.
Figure 2:
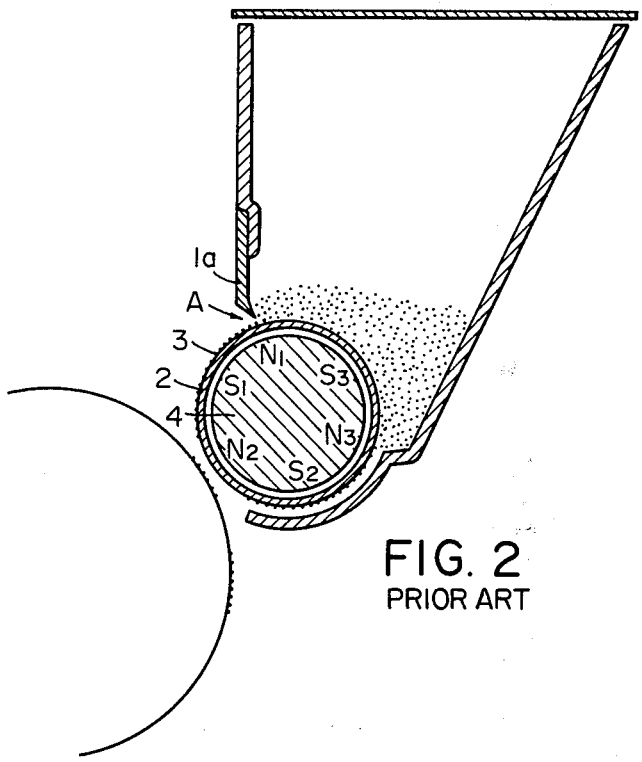
FIG. 2 PRIOR ART
FIG. 2 is a cross-sectional view of a developing device using a magnetic blade.

As a device for forming a uniform toner layer on a developer supporting member, there are known developing devices which use an applicator blade at the outlet of a toner container as shown in FIGS. 1 and 2.

In the device shown in FIG. 1, an elastic blade 1 of rubber or like material is urged against a developer supporting member 2 to thereby control the thickness of a toner layer 3.

In the device shown in FIG. 2, a blade 1*a* formed of a magnetic material is provided at a location opposed to one magnetic pole $N_1$ of a fixed magnet 4 enclosed in a developer supporting member 2 and toner is caused to erect along the magnetic line of force between said magnetic pole and said blade of magnetic material and the toner is cut by the edge portion of the end of the blade to thereby control the thickness of the toner layer by utilization of the action of the magnetic force. See, for example, U.S. application Ser. No. 938,494 abandoned in favor of Continuation U.S. application Ser. No. 267,771, filed May 28, 1981 by the assignee of this invention.

These methods have made it possible to form a substantially uniform toner layer on the developer supporting member 2. However, it has empirically been found that there are some cases where it is difficult to have a uniform toner layer stably formed on the developer supporting member for a practically long period of time. Particularly, it has been found that it is more difficult to form a uniform toner layer when use is made of toner of remarkably poor fluidity or when use is made of toner having created aggregation.

Irregularity of the thickness of the toner layer on the developer supporting member 2 (hereinafter referred to as the sleeve) may result in irregularity of the visualized image and cannot thus provide a good image. By observing in detail the phenomenon of creating such irregularity, the following fact has been found. That is, when the toner thickness is controlled by the blade 1*a*, the toner bulges out on that side of the blade which is adjacent to the photosensitive medium (the portion A in FIG. 2) and as shown in the enlarged cross-sectional view of FIG. 3, a pool of toner is created in the portion A. When this pool of toner reaches a certain limit amount, it is overcome by the conveying force of the sleeve and is transferred onto the sleeve to create such application irregularity as indicated at B. The toner lumps B present on the uniform toner layer portion as indicated at C would cause irregularity of the image. Such irregularity would include irregularity of density, irregular fog or the like. The shape of the toner lump B includes a spot pattern, a waveform spot pattern, a waveform pattern, etc. and it has been found that these patterns are created by the difference in the limit amount of the toner pool or the difference in environment.

Embodiments of the present invention will hereinafter be described in detail with reference to the drawings.

Figure 3:
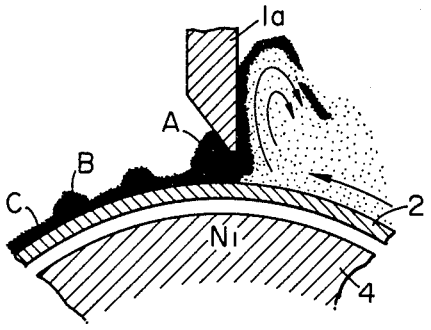
FIG. 3 is a fragmentary enlarged cross-sectional view of the FIG. 2 device.
Figure 4:
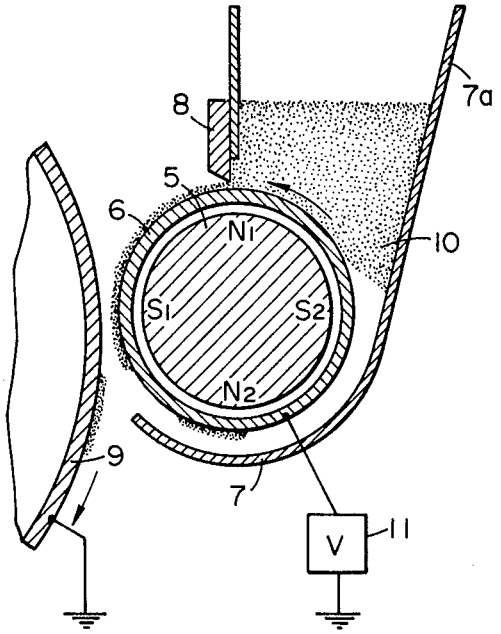
FIG. 4 is a cross-sectional view of an embodiment of the developing device to which the present invention is applied.

FIG. 4 is a cross-sectional view of an embodiment of the developing device to which the present invention is applied. In FIG. 4, reference numeral 5 designates a fixed magnet roller, 6 a movable sleeve, 7 a developer container, 7*a* a hopper portion, 8 a thickness controlling magnetic blade formed of a magnet or a magnetic material, 9 a photosensitive drum, and 10 a one-component magnetic toner. Designated by 11 is a power source for applying an alternating voltage between the sleeve 6 and the photosensitive drum 9. The details of this power source are described in the aforementioned U.S. application Ser. No. 264,516 and U.S. Pat. No. 4,292,387 and therefore, a detailed description of the operation thereof is omitted herein. In this developing device, toner 10 is stored in the hopper 7*a* and attracted onto the sleeve 6 by the magnetic force of the magnet roller 5. The toner on the sleeve is given charge by the friction between the toner and the rotating sleeve. By the added control agent contained in the toner, the toner is caused to have stable charge. The toner is conveyed to the blade portion by the rotating sleeve. A magnetic pole $N_1$ is disposed at a location opposed to the magnetic blade 8. The toner is controlled to a predetermined thickness by a magnetic field created between the blade 8 and the magnetic pole $N_1$ and by the gap between the blade 8 and the sleeve 6. The operation and effect in this aspect are described in detail in the aforementioned U.S. application Ser. No. 267,771. The toner left when the thickness thereof has been controlled by the blade forms on the developing side of the blade a certain magnitude of convection stream as shown in FIG. 3.

The sleeve is further rotated to become opposed to the photosensitive drum 9. The toner layer opposed to the photosensitive drum is caused to reciprocally move by the magnetic force of the developing magnetic pole $S_1$ and by the action of the low-frequency alternating electric field applied between the electrostatic latent image on the photosensitive drum and the sleeve and the toner adheres only to that portion of the photosensitive drum in which there is latent image charge. The toner left on the sleeve after the development is conveyed into the developer container by the rotation of the sleeve and by the magnetic forces of the conveyance magnetic poles $N_2$ and $S_2$.

Figure 5A:
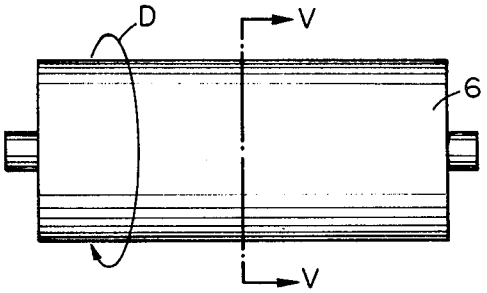
FIG. 5A is a plan view of the sleeve according to the present invention.
Figure 5B:
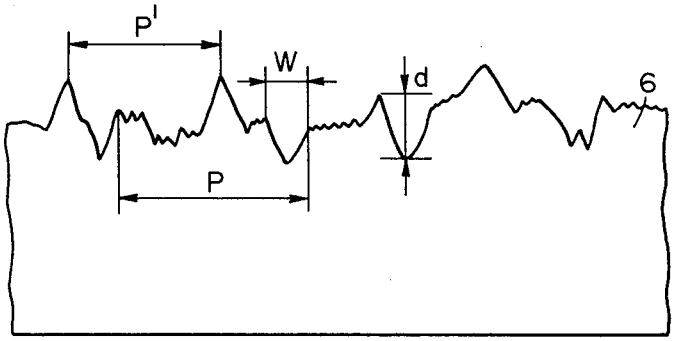
FIG. 5B is a fragmentary cross-sectional view of the sleeve taken along line V—V of FIG. 5A.

FIG. 5A is a plan view of the sleeve according to the present invention, and FIG. 5B is a fragmentary cross-sectional view of the sleeve taken along line V—V of FIG. 5A. The sleeve 6 according to the present invention has concavo-convexities provided on the surface thereof. These concavo-convexities are so formed as to repeat the concavo-convexity successively with respect to the circumferential direction of the sleeve, namely, the direction of rotation (arrow D) of the sleeve.

Heretofore, where the sleeve surface was smooth, toner was magnetically aggregated into a large lump upstream of the magnetic blade 1*a* with respect to the direction of movement of the sleeve 2 as shown in FIG.

3, and such lump bulged out of the blade 1*a* to accumulate in the portion A and create application irregularity. At this time, in the toner pool upstream of the blade, the aggregated toner depicted a convection stream of large radius as shown in FIG. 3.

In contrast, when toner coating has been effected by the use of the sleeve of the present invention having concavo-convexities circumferentially thereof, the application irregularity of toner resulting from the bulging-out of the toner has not occurred. It has also been observed that the radius of the toner convection stream in the toner pool upstream of the blade has become smaller than before. This is considered to be attributable to the fact that periodical fine vibrations are imparted to the toner pool upstream of the blade by the concavo-convexities provided circumferentially of the sleeve, so that the toner lump is unbound and the toner becomes smooth. For the purpose of creating such periodical vibrations, it has empirically been confirmed that the pitch P of the concavo-convexities (the average spacing between large concavities or between large convexities) may preferably be 5μ to 100μ.

It has also been confirmed that the following conditions must be satisfied in respect to the depth d of the concavities.

Firstly, it has been confirmed that d may preferably be 0.2μ or more to provide a uniform thickness of the toner layer. This is because, if d is less than 0.2μ, the friction coefficient between the toner and the sleeve surface is small.

Secondly, it has been confirmed that d may preferably be greater than 0.1μ and less than 10μ to impart sufficient friction charge to the toner. The reason is that too shallow concavities could not lead to the provision of friction charge resulting from the friction between the toner and the sleeve surface and that too deep concavities of 10μ or more would lead to the formation of a thicker toner layer which in turn would make the friction charging of the toner unstable and thus disturb the image.

Thirdly, it has been found that d may preferably be greater than 0.1μ and less than 15μ to prevent fusion of the toner to the sleeve. If the surface of the sleeve is smooth, the toner rather tends to slip on the sleeve surface and create fusion, and if d is greater than 15μ, the toner comes into the concavities to cause fusion.

From these points, the depth d of the concavities may preferably be 0.2μ to 10μ.

Also, if the width W of the concavities is narrow, the toner tends to clog the concavities and repeated contact between the toner and the sleeve would not take place to make triboelectrical charge unstable and disturb the image. Too great a width would offset the effect of the concavo-convexities provided on the sleeve surface. According, the width W may preferably be about two to three times the depth d.

Incidentally, the average particle diameter of the magnetic toner used is 5–30μ, preferably, 5–15μ.

Further, in the developing device as shown in FIG. 4 wherein the thickness of the toner layer is controlled to a thickness (50–300μ) less than the gap between the sleeve and the photo-sensitive drum (for example, 100–500μ) and an alternating voltage is applied between the sleeve and the drum to cause reciprocal movement of the toner therebetween to thereby effect the development, it has been confirmed that if the depth of the concavities exceeds 5μ, the toner scatters in all directions to aggravate the image reproducibility. This is because the alternating electric field applied between the sleeve and the drum concentrates in the concavities and the toner is attracted toward the stronger electric field. Accordingly, when the present invention is applied to the above-described developing method, the depth of the concavities may suitably be 0.2–5μ.

Figure 6:
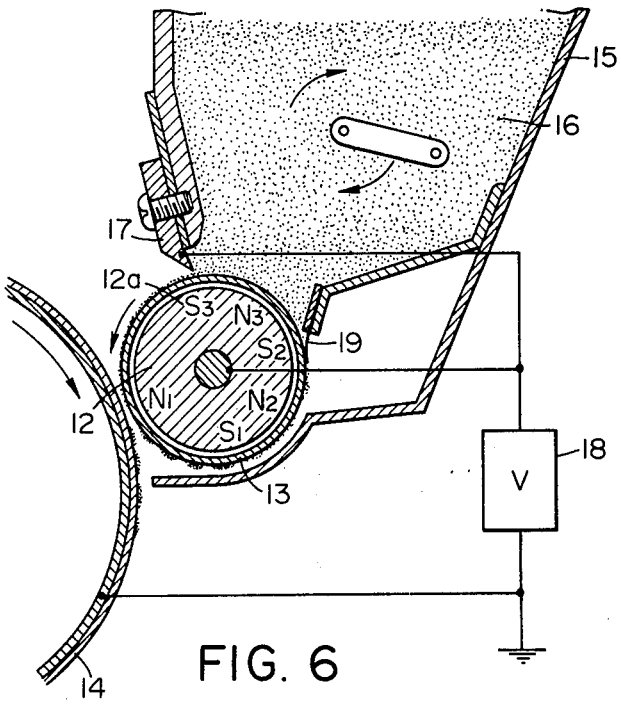
FIG. 6 is a cross-sectional view of another embodiment of the developing device to which the present invention is applied.

Reference is now had to FIG. 6 to describe another embodiment of the present invention. In the embodiment shown in FIG. 6, a multipole permanent magnet 12 having a developing magnetic pole $N_1$, a magnetic cutting pole $S_3$, a toner collecting magnetic pole $S_1$ and toner conveying magnetic poles $N_2$, $S_2$ and $N_3$ is fixed and a non-magnetic cylinder 13 which is a toner supporting member is disposed in proximity to and rotated in the same direction (the direction of arrow) as an electrostatic image bearing surface 14. By the rotation of the cylinder 13, one-component insulative ferromagnetic toner 16 fed from a toner container 15 is applied to the surface of the non-magnetic cylinder. The charging series of the cylinder and toner is selected such that, at this time, charge of the opposite polarity to the charge of the electrostatic image is imparted to the toner particles by the friction between the surface of the cylinder and the toner particles. Further, an iron doctor blade 17 is disposed in proximity to the surface of the cylinder (with a spacing of 50–500μ). The blade 17 is a sheet having its length extending in the direction of the bus bar of the non-magnetic cylinder surface, and may take the form as shown in FIG. 6, for example. The blade 17 is disposed in opposed relationship with one magnetic pole 12*a* (in the drawing, the pole $S_3$) of the multipole permanent magnet 12 to thereby uniformly control the toner layer to a small thickness (30–300μ, preferably, 30–200μ). By adjusting the velocity of this cylinder, the surface velocity of the toner layer, preferably, the interior velocity of the toner layer is adjusted to a velocity substantially equal or approximate to the velocity of the electrostatic image bearing surface. For the doctor blade 17, other magnetic material instead of iron may be used to form opposite magnetic poles. Alternatively, a magnet may be used. Designated by 18 is a power source for applying an alternating voltage between the non-magnetic cylinder 13 and the electrostatic image bearing member. Denoted by 19 is a scraper for removing residual toner from the surface of the toner carrying member. The blade 17 is rendered to the same potential as the toner carrying member to prevent toner application irregularity.

The magnetic toner used has been formed as by mixing 75 parts of polystyrene, 15 parts of magnetite, 3 parts of charge control agent and 6 parts of carbon in a well-known manner and has an average particle diameter of 5–30μ. Of course, utilization may be made of other well-known magnetic toners having such particle diameter distribution and containing magnetic powder greater than 15 weight percent and less than 50 weight percent.

In the developing device shown in FIG. 6, the surface of the non-magnetic cylinder 13 has been formed with concavo-concavities along the direction of rotation of the cylinder as in the case of FIG. 4 and when development has been effected by the use of such cylinder, no development irregularity has occurred to the image.

Some specific examples of the present invention will hereinafter be described.

EXAMPLE 1

In the developing device of FIG. 4, the diameter of the non-magnetic sleeve 6 was 50 mm, the magnetic pole $N_1=850$ gausses, $N_2=500$ gausses, $S_1=650$ gausses, $S_2=500$ gausses, iron which is a magnetic material was used for the blade 8, the gap between the blade and the sleeve was 250μ, one-component magnetic toner was used as the toner 10, AC with DC superimposed thereon was used as the bias voltage source 11, $V_{pp}=1200$ (V), f=800 ($H_3$), and DC=+100 (V).

Under these conditions, the surface of the sleeve was polished parallel to the axial direction (lengthwise direction) thereof by the use of sand paper #600 to form concavo-convexities having a pitch of about 20μ and a depth of about 0.5μ on the surface of the sleeve and experiment was carried out with such sleeve. The result was that toner coating was very good and no application irregularity occurred. When 10000 copies were continuously produced in this state, no development irregularity occurred to the image and very good images could always be maintained.

In the above example, concavo-convexities parallel to the axial direction were formed on the sleeve by the use of sand paper #600, but according to the experiment, it has been found that it is desirable to use sand paper #100–#800 and that even #50–#1000 are sufficiently fit for practical use. In this case, for #100, the pitch of the concavo-convexities is P=30μ–100μ and for #800, the pitch is P=5μ–10μ.

Figure 7:
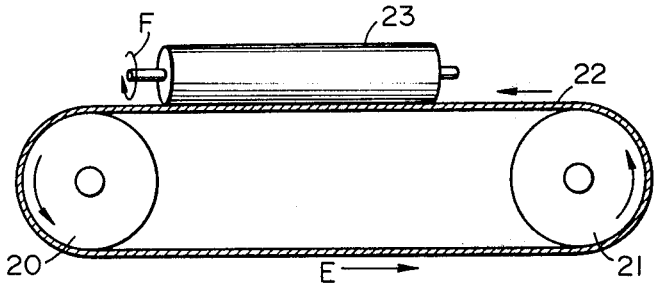
FIG. 7 illustrates an embodiment for forming concavo-convexities on the surface of the sleeve by the use of a belt sander.

Description will hereinafter be made of another example in which concavo-convexities are provided circumferentially of the sleeve, namely, parallel to the axial direction thereof. FIG. 7 illustrates an embodiment in which a belt sander is used to form concavo-convexities on the surface of the sleeve. By the rotation of pulleys 20 and 21, a belt 22 is moved round in the direction of arrow E. The surface of the belt 22 has the necessary roughness of grain size, for example, the roughness of sand paper #400, and a sleeve 23 is installed on the surface of the belt. When the sleeve 23 is slowly rotated in the direction of arrow F, the sleeve surface is polished axially thereof with the movement of the belt 22 and concavo-convexities are successively formed circumferentially thereof. At this time, the rotational velocity of the sleeve 23 must be much slower than the movement velocity of the belt 22.

Even if the rotational velocity of the sleeve is made slower as described above, the polishing direction is slightly deviated and oblique with respect to the sleeve axis. Therefore, in advance, the sleeve is installed slightly obliquely with respect to the movement direction of the belt. By this, it is possible to polish the sleeve surface in the direction of its major axis.

Figure 8:
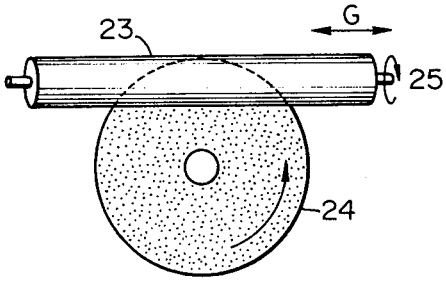
FIG. 8 illustrates another embodiment for forming concavo-convexities.

FIG. 8 shows an example in which the sleeve 23 is caused to bear against a disc 24 provided with grains in the manner as shown and the disc 24 is rotated to thereby polish the sleeve surface substantially along the axial direction thereof. However, with this, only a part of the sleeve surface is polished and so, the sleeve is reciprocally moved in the direction of double-headed arrow G, namely, in the axial direction of the sleeve, whereafter the sleeve is rotated in the direction of arrow 25. In this manner, axial concavo-convexities are formed on the entire area of the sleeve surface.

Also, parallel grooves of 1–5μ have been formed on the sleeve surface lengthwisely thereof by the use of the extrode horn machining method in which semi-solid visco-elastic material including #50 to #500 polishing material powder, for example, foron carbide, diamond grain or the like, is pressed against a workpiece at a high pressure to form uniform linear streaks on the surface of the workpiece and when such sleeve has been used for the image formation, it has been possible to accomplish very good image reproduction.

As described above, concavo-convexities of the order of several microns are provided on the surface of the developer supporting member 6 or 13, whereby at the location whereat the blade 8 or 17 is disposed, the toner is mechanically unbound by the friction between the toner and the concavo-convex surface of the toner supporting member 6 or 13, thus enabling uniform application of the toner. However, according to the experiment carried out by the inventor, it has been found that there are several conditions about the shape and size of the concavo-convexities in order that a sufficient effect may further be displayed without adversely affecting the developing characteristic. Those conditions obtained as the result of the experiment will hereinafter be described.

Figure 9A:
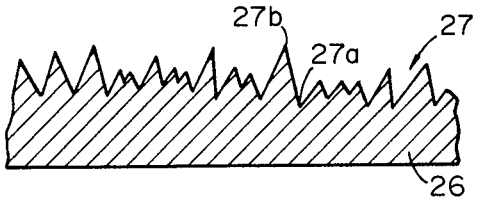
FIGS. 9(A) to (D) are enlarged cross-sectional views showing the surface configurations of the developer supporting members used in experiments.
Figure 9B:
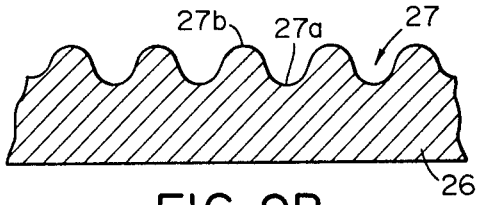
Figure 9C:
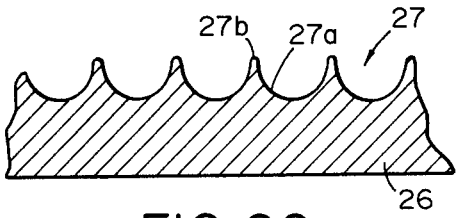
Figure 9D:
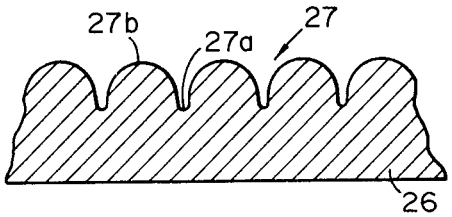

FIGS. 9(A) to (D) are four examples showing in cross-section the shape of the surface of the developer supporting member 26 used in the experiments. In FIG. 9(A), both the valleys 27*a* and peaks 27*b* of the concavo-convexities 27 are sharp. With such shape, it is possible to form a uniform toner layer but the developed image tends to become thin in density and it has also been found that the outline of the visualized image does not become rectilinear but when enlarged, it tends to present a thin sawtooth-like configuration. FIG. 9(B) shows a shape in which both the valleys 27*a* and peaks 27*b* are rounded, FIG. 9(C) shows a shape in which the valleys 27*a* are rounded, and FIG. 9(D) shows a shape in which the peaks 27*b* are rounded. In the examples shown in FIGS. 9(B), (C) and (D), it has been found that good developed images may be obtained if the following conditions about the size of the concavo-convexities 27 are satisfied.

Figure 10:
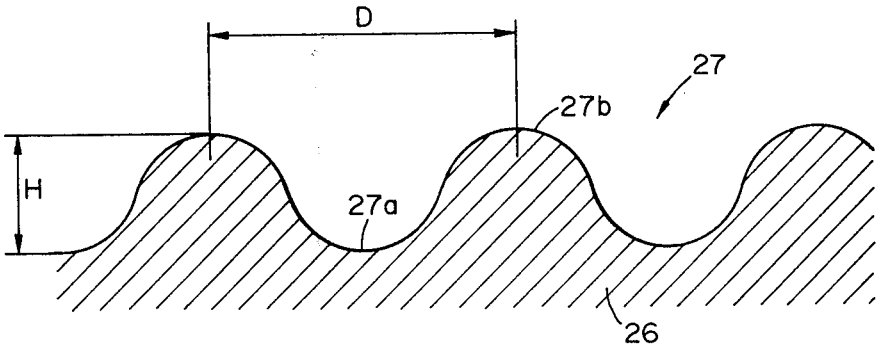
FIG. 10 is an enlarged cross-sectional view showing the relation between the height H of the peaks of the concavo-convexities on the surface of the developer supporting member and the distance D between the peaks.

That is, as regards the size of the concavo-convexities 27, the height H of the peaks shown in FIG. 10 should preferably be $\frac{1}{4}$ to three times the average particle diameter of the toner, and should optimally be $\frac{1}{3}$ to equal to the average particle diameter. When the height H is less than $\frac{1}{4}$ of the average particle diameter of the toner, there is little or no effect of the concavo-convexities 27 being provided, and when the height H exceeds three times, the density of the developed image becomes lower and fog tends to occur.

Since the particle diameter of the toner usually used is of the order of 5–20μ, the size of the concavo-convexities 27 should optimally be 2 to 20μ. Also, the intermountain distance D must be greater than the height H of the mountains. When D is smaller than the height H, the density of the developed image becomes lower and, when D is excessively great, there is no effect of the concavo-convexities. In this case, the pattern of the concavo-convexities of the developer supporting member appears in the image, but as the result of the experiment, it has been found that if the size of the concavo-convexities is smaller than the gap between the developer supporting member 26 and the latent image bearing member, the pattern of the concavo-convexities 27 does not appear in the image and there is a sufficient effect of such concavo-convexities.

The cause of these phenomena cannot be seen in detail, but may generally be inferred as follows:

If the shape of the peaks 27*b* is sharp as shown in FIG. 9(A), it is inferred that the electric field concentrates on this portion and the electric field by the latent image does not sufficiently reach the toner particles and therefore, insufficient development tends to take place. In respect of the concentration of the electric field, the shape shown in FIG. 9(C) wherein the top of the mountains 27*b* is sharp is similar to the case of FIG. 9(A), but the valleys 27*a* are greatly rounded and so, of the shapes shown in FIGS. 9(A)–(D), the capacity of the valleys 27*a* shown in FIG. 9(C) is greatest and therefore, the amount of toner supplied for the development is so great as to cover the demerit of the concentrated electric field.

Particularly, in the constructions as shown in FIGS. 1, 2, 4 and 6 wherein magnetic poles are provided in the developing station, it is observed through a magnifier that the toner between the valleys 27*a* assume a brush-like form under the influence of the magnetic field and the height thereof becomes sufficiently higher than the top of the peaks 27*b*.

The height H of the peaks 27*b* must be sufficiently great to mechanically unbind the toner, whereas if the height H is excessively great, the toner will not be unbound but will be forced into the valleys 27*a* and the charging of the toner will not sufficiently be effected, thus preventing good development from being accomplished. Also, under the action of the magnetic field, the toner forms brushes not only in the valleys 27*a* but also on top of the peaks 27*b*. When the height of the peaks 27*b* is great, the toner which has so far lied in the valleys 27*a* forms high brushes on top of the peaks 27*b* and such brushes cause friction with the latent image bearing member thus resulting in fog.

When the distance D between the peaks 27*b* is smaller than the height of the peaks 27*b*, the toner in the valleys 27*a* is electrically shielded and is not used for the development. Also, the adhering force of the toner to the developer supporting member 26 is increased. Therefore, the distance between the peaks 27*b* should desirably be relatively great. In this case, however, there is a possibility that the pattern of the developer supporting member 26 appears on the image. But it has been found that when the distance between the peaks 27*b* is smaller than the spacing between the developer supporting member and the latent image bearing member, the influence thereof hardly presents itself.

This is inferred to be probably attributable to the fact that when the toner shifts from the developer supporting member to the latent image bearing member, it does not always move in a direction perpendicular to the surface of the developer supporting member but some of the toner moves obliquely.

The concavo-convexities 27 of such shape and size can be made by any of a chemical method and a mechanical method.

As a chemical method, the surface of the developer supporting member which is formed of stainless steel or the like may be etched as by a solution of various acids and ferric chloride to thereby form on the surface thereof such concavo-convexities as shown in FIG. 9(B) or 9(D).

As a mechanical method, the so-called blast treatment in which bead-like abrasives (glass beads, marteusite, or the like) are blown may be used to form such shape as shown in FIG. 9(C).

In any case, concavo-convexities may once be formed, whereafter they may be subjected to very weak electrolytic polishing so that the tops of the peaks may be rounded. When the developer supporting member is fabricated by lathe machining, concavo-convexities may also be formed by leaving grooves thereon, but the concavo-convexities thus formed are not effective in that the peaks and valleys are uniformly connected in the circumferential direction of the developer supporting member, namely, in a direction parallel to the axis of the sleeve.

To achieve the objects of the present invention, the concavities must be random ones including parallel-direction components or must be ones which are connected together in the lengthwise direction of the developer supporting member. In the case of the random concavities, other elements than the parallel-direction components are also included and so, a great number of peaks are formed and the electric field may concentrate upon these peaks to provide insufficient development. It is therefore preferable that the concavo-convexities may be formed only by horizontal-direction components connected in the lengthwise direction of the developer supporting member.

Also, when the blast treatment is resorted to, the abrasives should preferably be in the form of beads. This is because the use of sand-like (amorphous) abrasives could not result in the formation of the surface configurations as shown in FIGS. 9(B)–(D).

It will be apparent that the present invention is also applicable to the developing devices of the prior art illustrated in FIGS. 1 and 2.

As has been described above in detail, according to the present invention, concavo-convexities are provided on the surface of the developer supporting member along the conveyance direction thereof, so that a uniform thin layer of magnetic toner can be formed on the supporting member. Also, by suitably selecting the size of the concavo-convexities, good frictional charging of the toner can be accomplished and the fusion of the toner onto the surface of the supporting member can be prevented, thus providing good images.

What I claim is:

1. A developing device for developing a latent image on a latent image bearing member by imparting a one-component toner to the latent image, said device comprising:

means for supplying one-component magnetic toner;

a member for supporting on its surface toner supplied from said supply means;

magnetic field generating means disposed within said supporting member; and a thickness controlling member disposed in proximity to said supporting member for controlling the thickness of a layer of toner formed on the surface of said supporting member;

wherein said developer supporting member has concavo-convexities on the surface thereof, said concavo-convexities including at least repeating peaks and valleys formed along the direction of movement of the toner, said concavo-convexities having a depth of 0.2–10$\mu$.

2. The developing device according to claim 1, wherein said concavo-convexities on the surface of said supporting member are formed only by horizontal components connected together in a direction perpendicular to the direction of movement of the developer.

3. The developing device according to claim 1, wherein said magnetic field generating means is fixed and said supporting member is movable.

4. A developing device for developing a latent image on a latent image bearing member by imparting a one-component to the latent image, said device comprising:

a container for containing one-component magnetic toner therein;

a sleeve as a toner supporting member rotatably supported by said container;

a magnet roller as magnetic field generating means fixedly disposed within said sleeve; and a blade as a thickness controlling member disposed in proximity to said sleeve for controlling the thickness of the toner on the surface of said sleeve;

wherein said sleeve has concavo-convexities on the surface thereof, said concavo-convexities being formed only by horizontal components connected together in the axial direction of said sleeve, said concavo-convexities having a depth of 0.2–10μ.

5. The developing device according to claim 1 or 4, wherein said concavo-convexities have a pitch P of 5–100 μ, and a concavity width W of 2d–3d.

6. The developing device according to claim 1 or 4, wherein said thickness controlling member is a magnetic blade formed of a magnetic material or a magnet.

7. The developing device according to claim 6, wherein said magnetic field generating means has a magnetic pole at a position opposed to said magnetic blade.

8. The developing device according to claim 1 or 4, wherein the thickness of the toner layer is controlled to less than the spacing between latent image bearing member and said supporting member by said thickness controlling member and a clearance is formed between the latent image bearing member and the surface of the toner layer.

9. The developing device according to claim 8, further comprising an insulative one-component magnetic toner.

10. The developing device according to claim 8, further comprising means for applying an alternating electric field to the clearance.

11. The developing device according to claim 10, wherein the depth d of the concavities is 0.2–5μ.

12. The developing device according to claim 10, wherein said thickness controlling member is maintained at the same potential as said supporting member.

13. The developing device according to claim 8, wherein the spacing between said supporting member and the latent image bearing member is 100–500μ.

14. The developing device according to claim 8, wherein said thickness controlling member controls the thickness of the toner layer to 30–300μ.

15. The developing device according to claim 1 or 4, further comprising a scraper for removing any residual toner from the surface of said supporting member.

16. The developing device according to claim 1 or 4, wherein at least one of the peaks and the valleys of said concavo-convexities are rounded.

17. The developing device according to claim 16, wherein the height H of the peaks of said concavo-convexities is $\frac{1}{3}$ to equal to the average particle diameter of the toner.

18. A developing device for developing a latent image on a latent image bearing member by imparting a one-component developer having an average particle size of about 30μ or less to the latent image, said device comprising:

means for supplying one-component developer; and a developer supporting member for carrying supplied developer on the surface thereof to a developing station where the developer supporting member faces the image bearing member, said developer supporting member having a rough surface formed with numerous concavo-convexities the heights of which are $\frac{1}{4}$ to 3 times the average particle size of the one-component developer.

19. A developing device according to claim 16, wherein the distance between the tops of adjacent convexities is larger than the height of the convexities.

20. A device according to claim 18 or 19, further comprising a member, disposed adjacent said developer supporting member, for controlling the thickness of the developer layer on said developer supporting member.

21. A device according to claim 1, wherein said controlling member is of a resilient material.

22. A device according to claim 20, wherein said controlling member is of a resilient material.

23. A device according to claim 18 or 19, wherein the rough surface of said developer supporting member is formed by blast treatment.

* * * * *

UNITED STATES PATENT AND TRADEMARK OFFICE

CERTIFICATE OF CORRECTION

PATENT NO. : 4,377,332

DATED : March 22, 1983

INVENTOR(S) : YASUYUKI TAMURA

It is certified that error appears in the above-identified patent and that said Letters Patent is hereby corrected as shown below:

Column 12, line 31, Claim 19, "16" should read --18--.

Signed and Sealed this

*Fifteenth* Day of *November 1983*

[SEAL]

*Attest:*

GERALD J. MOSSINGHOFF

*Attesting Officer*

*Commissioner of Patents and Trademarks*